US009447526B2

(12) United States Patent
Stundl et al.

(10) Patent No.: US 9,447,526 B2
(45) Date of Patent: Sep. 20, 2016

(54) METHOD AND DEVICE FOR PRODUCING INTERTWINING KNOTS

(75) Inventors: Mathias Stundl, Wedel (DE); Claus Matthies, Ehndorf (DE); Jan Westphal, Schulp (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 288 days.

(21) Appl. No.: 14/240,262

(22) PCT Filed: Apr. 23, 2012

(86) PCT No.: PCT/EP2012/057382

§ 371 (c)(1), (2), (4) Date: May 20, 2014

(87) PCT Pub. No.: WO2013/029810

PCT Pub. Date: Mar. 7, 2013

(65) Prior Publication Data

US 2014/0250646 A1 Sep. 11, 2014

(30) Foreign Application Priority Data

Aug. 30, 2011 (DE) ..... 10 2011 112 017

(51) Int. Cl.
*D02G 1/16* (2006.01)
*D02J 1/08* (2006.01)

(52) U.S. Cl.
CPC ..... *D02G 1/161* (2013.01); *D02G 1/162* (2013.01); *D02J 1/08* (2013.01)

(58) Field of Classification Search
CPC ..... D02G 1/16; D02G 1/161; D02G 1/162; D02G 1/008; D02G 1/024; D02G 1/164; D02G 1/167; D02J 1/06; D02J 1/08; D01H 4/02
USPC ..... 28/271, 252, 276, 274, 275; 57/908, 57/350, 289, 293
See application file for complete search history.

(56) References Cited

U.S. PATENT DOCUMENTS 3,110,151 A * 11/1963 Bunting, Jr. ..... D02J 1/08 28/258
3,394,440 A * 7/1968 Van Holten ..... D02J 1/08 28/272

(Continued)

FOREIGN PATENT DOCUMENTS

DE 4113927 A1 11/1992
DE 4140469 A1 6/1993

(Continued)

OTHER PUBLICATIONS

English language machine translation of DE 4113927 (Nov. 1992), 4 pages.*

(Continued)

*Primary Examiner* — Amy Vanatta
(74) *Attorney, Agent, or Firm* — BainwoodHuang

(57) ABSTRACT

Techniques produce intertwining knots in a multifilament thread. In such techniques, an air stream pulse is generated by a nozzle channel opening into a treatment channel periodically with an interval between successive air stream pulses. During an interval, the air stream pulse is directed transversely onto the thread guided in the treatment channel so that a continuous sequence of intertwining knots is produced in the running thread. An auxiliary air stream is generated continuously or discontinuously and the auxiliary air stream and the air stream pulse are blown in together into the treatment channel.

19 Claims, 8 Drawing Sheets

(56) References Cited

U.S. PATENT DOCUMENTS

Figure 1:
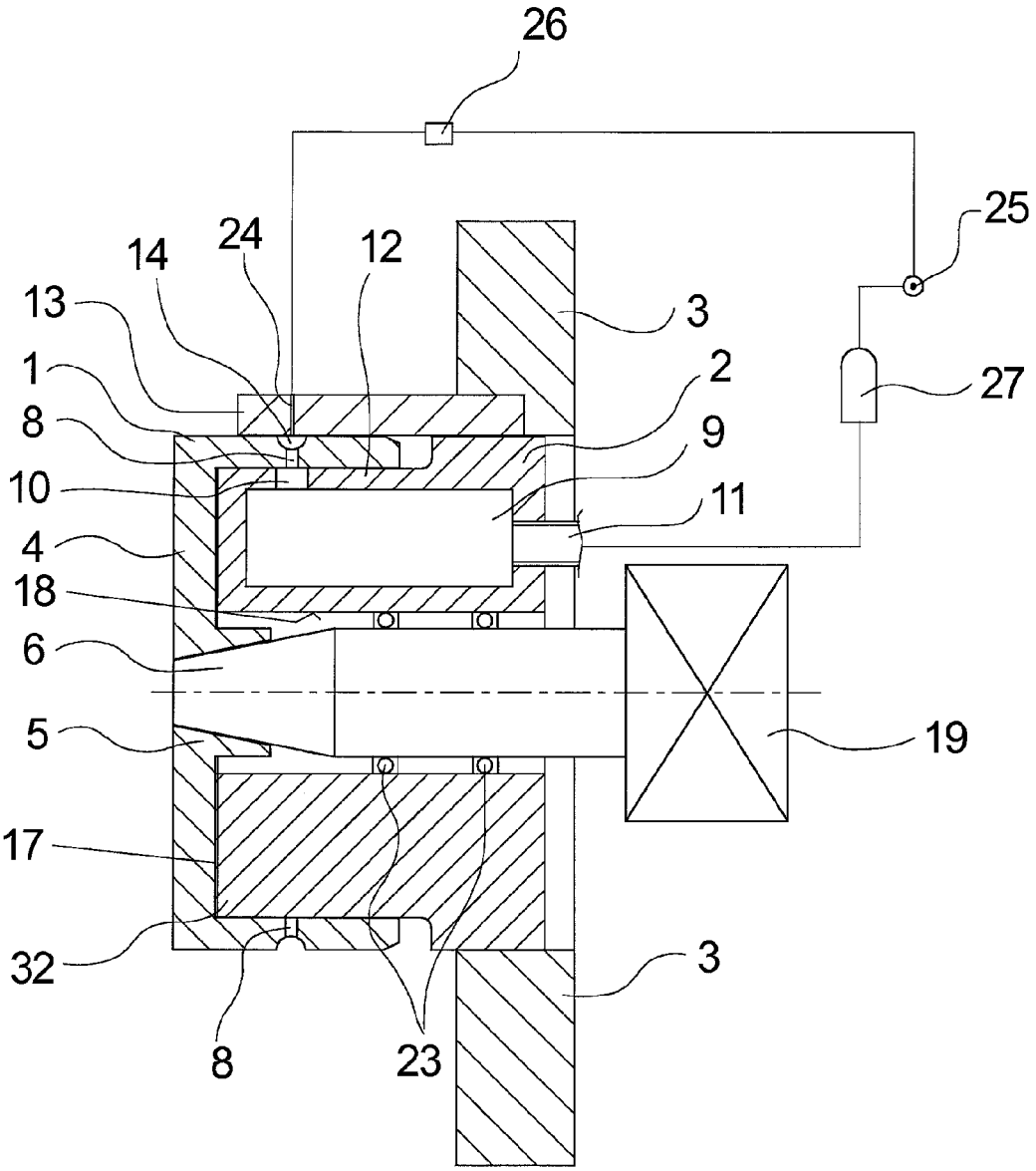

| | | | | | |
|---|---|---|---|---|---|
| RE27,717 | E * | 8/1973 | Breen | D02G 1/04 | 57/283 |
| 3,937,252 | A * | 2/1976 | Ishida | F15B 21/125 | 137/624.13 |
| 4,058,960 | A * | 11/1977 | Movshovich | D02G 3/286 | 137/624.13 |
| 5,134,840 | A * | 8/1992 | Niederer | D02G 1/162 | 57/204 |
| 6,089,009 | A * | 7/2000 | Hand | D02G 1/161 | 57/282 |
| 2002/0043162 | A1* | 4/2002 | Laird | D06C 3/04 | 101/116 |
| 2005/0011061 | A1* | 1/2005 | Buchmuller | D02J 1/08 | 28/252 |
| 2012/0144633 | A1* | 6/2012 | Kaulitzki | D02G 1/161 | 28/271 |

FOREIGN PATENT DOCUMENTS

| | | | | |
|---|---|---|---|---|
| DE | 19501309 | A1 * | 8/1995 | D02J 1/08 |
| GB | 1593815 | A * | 7/1981 | D02G 3/34 |
| JP | S53122836 | A | 10/1978 | |
| WO | 03029539 | A1 | 4/2003 | |

OTHER PUBLICATIONS

English language machine translation of DE 4140469 (Jun. 1993), 6 pages.*

* cited by examiner

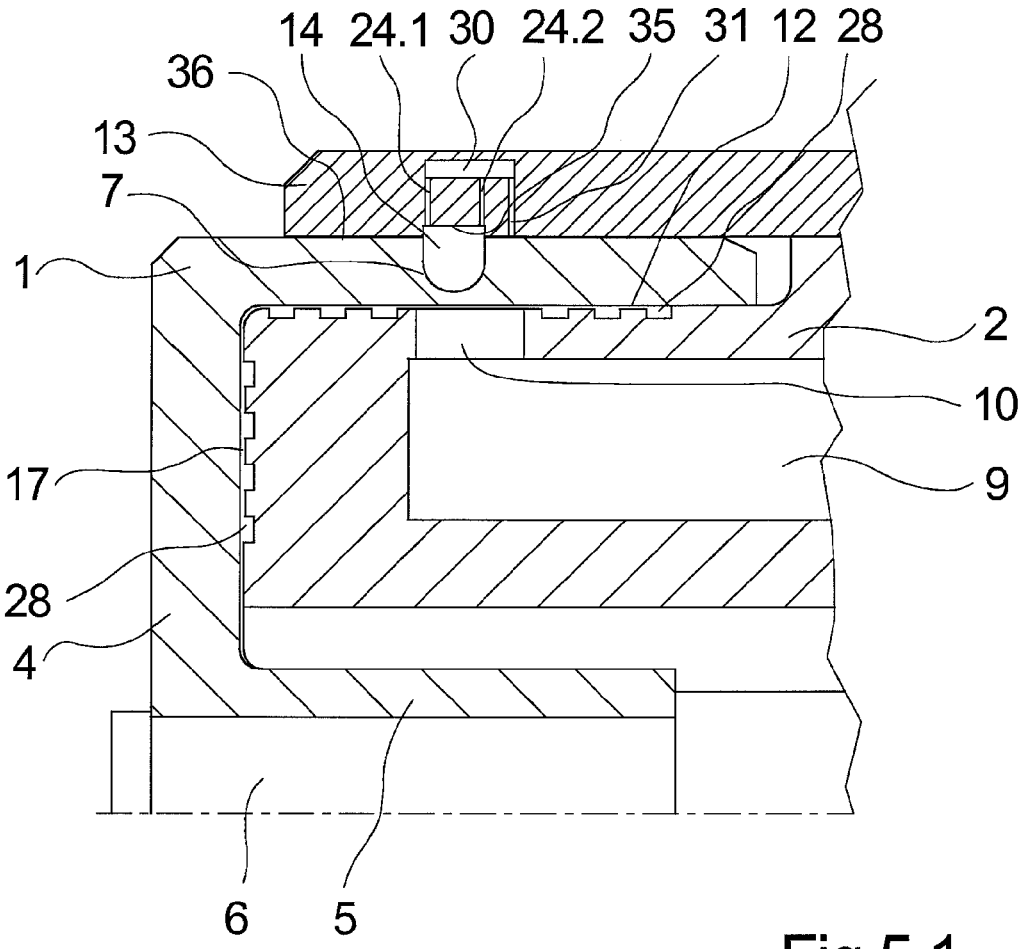
Fig.5.1

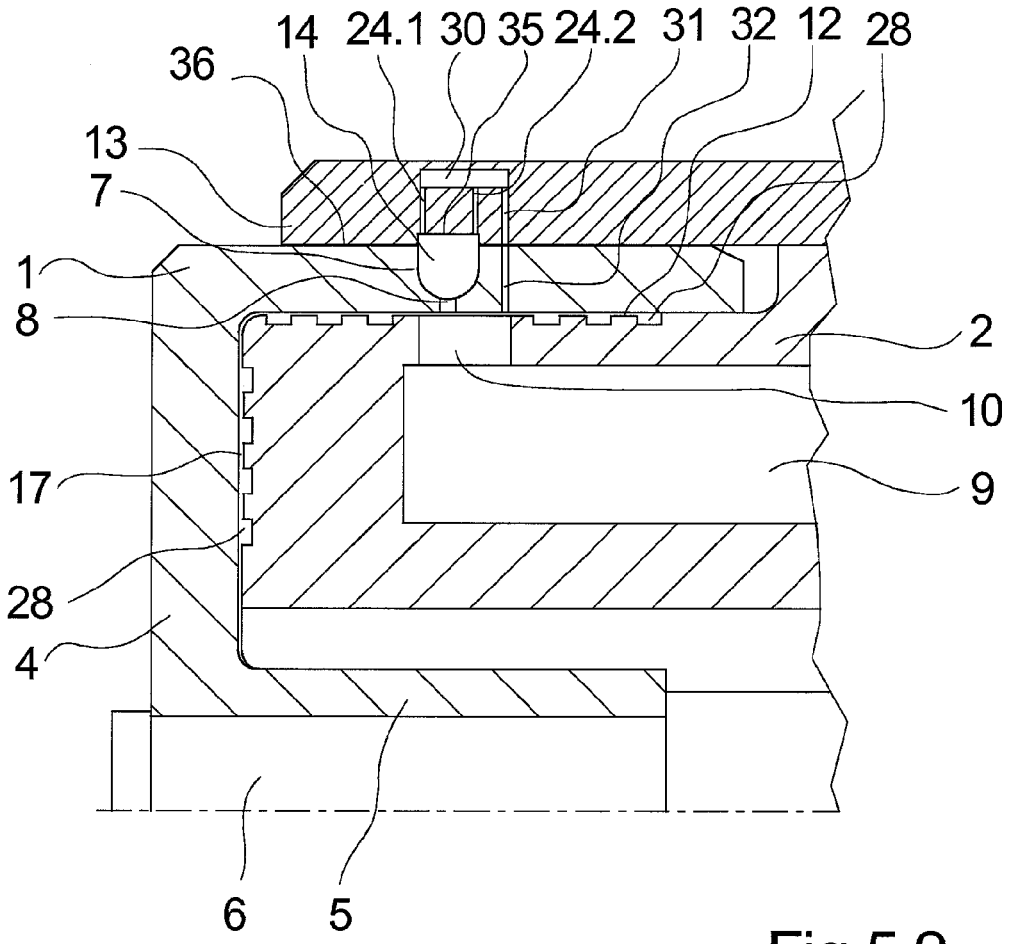
Fig.5.2

METHOD AND DEVICE FOR PRODUCING INTERTWINING KNOTS

The invention relates to a method for producing intertwining knots in a multifilament thread as disclosed herein as well as a device for producing intertwining knots in a multifilament thread as disclosed herein.

A generic method as well as a generic device for producing intertwining knots in a multifilament thread are known from DE 4140469 A1.

In the production of multifilament threads it is generally known that the individual strands of filaments in the thread are held together by so-called intertwining knots. Such intertwining knots are produced by a compressed air treatment of the thread. In this case, depending upon the thread type and process, the required number of intertwining knots per unit of length as well as the stability of the intertwining knots may be subject to different requirements. In particular in the production of carpet yarns which are used immediately after a melting and spinning process for further processing, a high knot stability as well as a large number of intertwining knots per unit of length of the thread are desirable.

In order in particular to produce a relatively large number of intertwining knots at higher yarn speeds, the generic device has a rotating nozzle ring which co-operates with a stationary stator. The nozzle ring has on the circumference a thread guiding groove, and a plurality of radially oriented nozzle orifices uniformly distributed over the circumference open into the base of said groove. The nozzle orifices penetrate the nozzle ring from the guide groove to an inner surface provided on the circumference of the stator. The stator has an internal pressure chamber which is connected by a chamber opening formed on the circumference of the stator. The chamber opening on the stator as well as the nozzle orifices in the nozzle ring lie in a plane so that when the nozzle ring rotates the nozzle orifices are delivered one after the other to the chamber opening. The pressure chamber is connected to a compressed air source, so that during the co-operation of the nozzle orifice and the chamber opening a compressed air pulse is produced in the thread guiding groove of the nozzle ring.

Above the chamber opening a cover is associated with the nozzle ring, which cover closes a portion of the guide groove on the circumference of the stator and jointly with the nozzle ring forms a treatment channel in which the air stream pulse generated by the nozzle channel enters and acts on the thread. In this case it is necessary that the intensity and the duration of the air stream pulse are selected in such a way that turbulence of the air stream forming in the treatment channel has the effect of forming the intertwining knots on the multifilament thread. Thus it is known that inside the treatment channel the air stream pulse blows in the direction of the cover into the bundle of filaments led through the nozzle channel. The air stream pulse entering the treatment channel is braked by the opposing cover and is deflected to a plurality of part-streams. This produces the necessary twisting and tangling of the strands of filaments which lead to the intertwining knots. This operation is substantially influenced by the pulse time, which determines the duration of the air stream pulse flowing into the treatment channel, and by the volumetric flow of the air stream pulse. In this case the correlation is generally to be observed that the longer the pulse time and the greater the volumetric flow of the air stream pulse is, the more intensive and the stronger is the formation of the intertwining knots.

The object of the invention is to improve the generic method as well as the generic device for production of intertwining knots in a multifilament thread in such a way that even in the case of relatively low volumetric flows and short pulse times it is possible to produce very pronounced intertwining knots in the thread.

This object is achieved according to the invention by a method with the features disclosed herein and by a device with the features disclosed herein.

Advantageous modifications of the invention are defined by the features and combinations of features disclosed herein.

The invention was also not rendered obvious by WO 2003/029539 A1, which discloses a method and a device for swirling multifilament threads. In addition to a main bore a plurality of auxiliary bores open in a treatment channel formed between two plates, so that in the treatment channel in addition to a permanently generated main air stream a plurality of constant auxiliary air streams which jointly act on the thread are introduced in the treatment channel. In this case a substantially constant flow of air occurs inside the treatment channel. However, no dynamic changes in flow occur in the treatment channel, such as are caused for example by the air stream pulse in the invention. In this respect the discoveries of the known method and the known device not adopted as obvious.

On the other hand the invention is based on the fact that an air stream pulse repeatedly blown in with a predetermined frequency inside the treatment channel in order to generate dynamic changes in flow is supported in such a way that its action for forming intertwining knots on the multifilament thread is improved. Surprisingly it has been shown that both a continuously generated auxiliary air stream and also a discontinuously generated auxiliary air stream, which are blown in together with the air stream pulse into the treatment channel, led to an intensification and increase in the knot formation. Thus it was possible to reduce the pulse time during which the air stream pulse is blown into the treatment channel. The auxiliary air stream has a substantially smaller volumetric flow by comparison with the air stream pulse, so that even with a continuous delivery of the auxiliary air stream a saving of energy could be achieved. Thus the method according to the invention is particularly suitable in order to support the dynamic compressed air streams of the air stream pulse inside the treatment channel in such a way that with the same knot quality the compressed air level of the air stream pulse can be reduced.

In order to be able to blow the auxiliary air stream into the treatment channel in a targeted manner as far as possible, use is preferably made of the variant of the method in which the auxiliary air stream is blown through at least one auxiliary nozzle channel into the treatment channel, wherein the auxiliary air stream and the air stream pulse act on the thread with a different blowing direction. Thus additional effects can be achieved by the auxiliary air stream in order for example to influence the position of the thread inside the treatment channel. A permanently generated auxiliary air stream having the opposite blowing direction with respect to the air stream pulse would, for example in the intervals, make it possible to guide the thread in the mouth region of the nozzle channel.

In order that, even at high thread running speeds, a high number of intertwining knots per length of thread can be produced, it must be possible to generate the air stream pulse with a relatively high frequency. The variant of the method in which the interval and the pulse time of the air stream pulses can be influenced by a rotational speed of a driven nozzle ring has proved particularly worthwhile for this purpose, wherein the nozzle ring supports the nozzle channel and connects this to a pressure source periodically by turning. Thus even in high-speed processes a sufficient variation of intertwining knots can be produced in the thread, wherein the rotational speed can be varied with a frequency in the range from 0.5 Hz to 20 Hz.

In this variant of the method the auxiliary air stream can preferably be generated in pulses, so that the auxiliary air stream only enters the treatment channel at the pulse time. For this purpose the supply of the auxiliary nozzle channel can be combined with the nozzle ring in such a way that the auxiliary nozzle channel is periodically connected to the compressed air source only by rotation of the nozzle ring.

Alternatively, however, it is also possible for the auxiliary air stream to be generated continuously during the intervals and the pulse times. In this case the auxiliary nozzle channel is preferably coupled by means of a stationary cover to the compressed air source.

However, the method according to the invention is not limited to generating the air stream pulses incoming into the treatment channel by means of a rotating nozzle ring. In principle the method according to the invention can also be carried out by devices which have stationary means and in which the air stream pulses are generated by valve controls.

However, for the multifilament threads produced in a melting and spinning process at relatively high yarn speeds a relatively high frequency of the air stream pulses is required for generating the intertwining knots, so that the device according to the invention is particularly suitable in order to generate a large number of stable intertwining knots with relatively low consumption of compressed air. For this purpose the device according to the invention has in the nozzle ring and/or in the cover at least one auxiliary nozzle channel which opens into the treatment channel, wherein the auxiliary nozzle channel can be connected constantly or periodically to the compressed air source. Thus, depending upon the thread type and the number of filaments, auxiliary air streams which are blown into the treatment channel together with the air stream pulse can be generated continuously or discontinuously.

In order to require the lowest possible volumetric flows in the generation of the auxiliary air stream, the device according to the invention is preferably constructed in such a way that the auxiliary nozzle channel has a free flow cross-section which is smaller than the flow cross-section of the nozzle channel. Thus for example in spite of very widely differing volumetric flows the compressed air supply can be carried out by means of a common compressed air source.

The modification of the invention, in which the auxiliary nozzle channel and the nozzle channel open, offset with respect to one another, into the treatment channel in such a way that different blowing directions can be produced, is particularly advantageous in order to be able to influence the compressed air flow in a targeted manner inside the treatment channel and to be able to influence the position of the thread in a targeted manner.

This effect can be further improved, as the cover has a plurality of auxiliary nozzle channels which are constructed opposite the guide groove of the nozzle ring can be connected jointly to the compressed air source.

In order to enable a generation of the auxiliary air stream in pulses, in spite of an opposing blowing direction of the auxiliary nozzle channels, the device according to the invention is preferably constructed in such a way that the cover has a distribution chamber and a supply channel which opens into the distribution chamber, wherein an opposite end of the auxiliary nozzle channel opens into the distribution chamber and wherein the supply channel co-operates periodically with a through channel in the nozzle ring. Thus with rotation of the nozzle ring the auxiliary air stream is generated through the auxiliary nozzle channel only during the pulse time.

The generation of the auxiliary air stream and the generation of the air stream pulse can also be performed alternatively with a different pressure level of the compressed air. For this purpose the modification of the invention, in which the supply channel in the nozzle ring co-operates by means of an auxiliary chamber opening with a separate auxiliary pressure chamber in the stator, is particularly suitable.

Furthermore, in order to generate a plurality of auxiliary air streams directly through the rotating nozzle ring, it is provided that alternatively the nozzle ring has two opposing auxiliary nozzle channels which open into the side walls of the guide groove, wherein the auxiliary nozzle channels co-operate through a plurality of supply channels by means of the chamber opening of the pressure chamber in the stator. Thus passage through a sealing joint, which is usually formed between the nozzle ring and the cover, can be avoided.

The method according to the invention and the device according to the invention are particularly suitable in order to produce a large number of stable pronounced intertwining knots with uniformity and a predetermined sequence with minimal energy consumption on multifilament threads at thread speeds of more than 3000 m/min.

The invention is explained in greater detail below on the basis of several embodiments of the device according to the invention with reference to the appended drawings.

Figure 2:
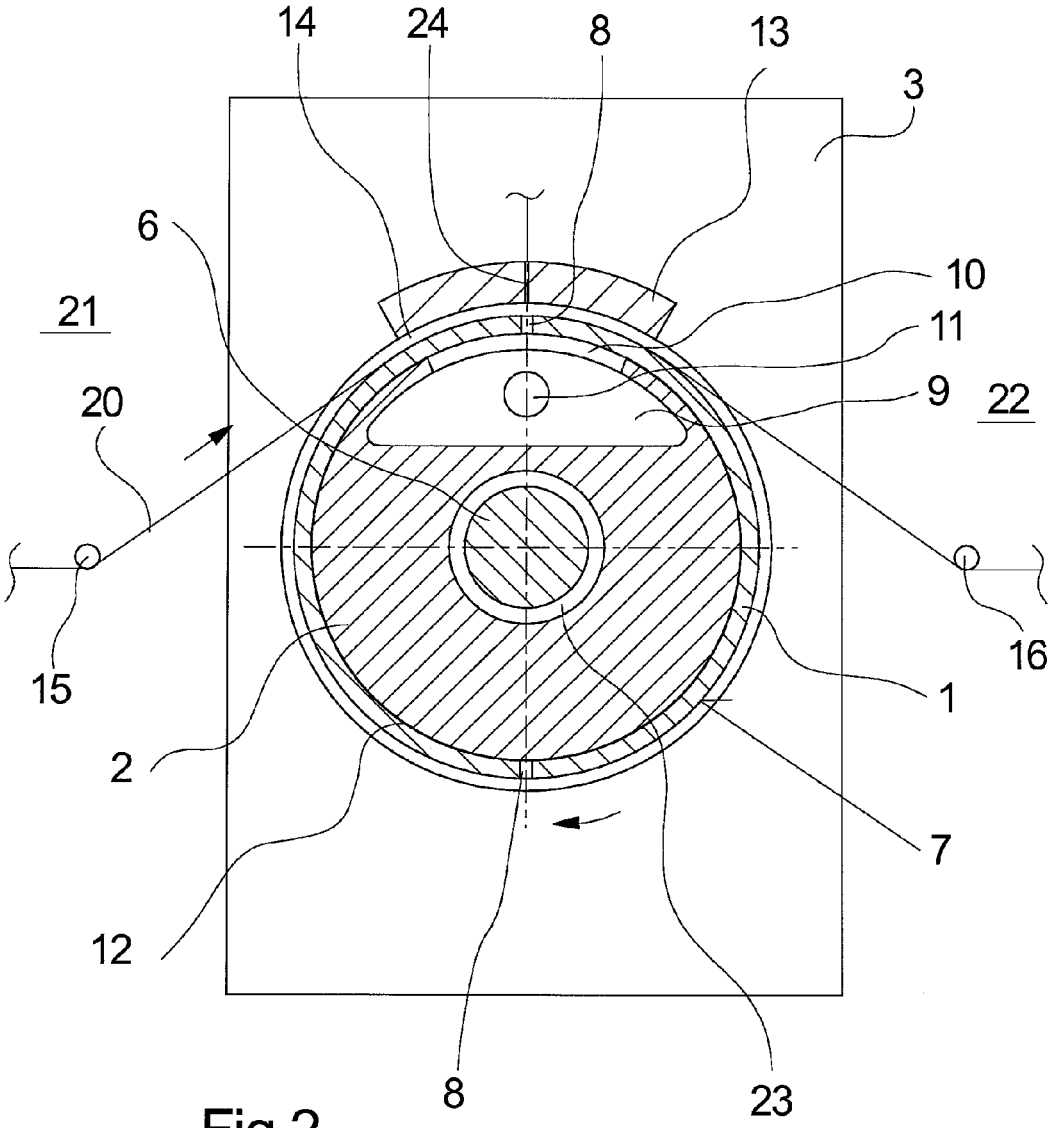
Figure 3:
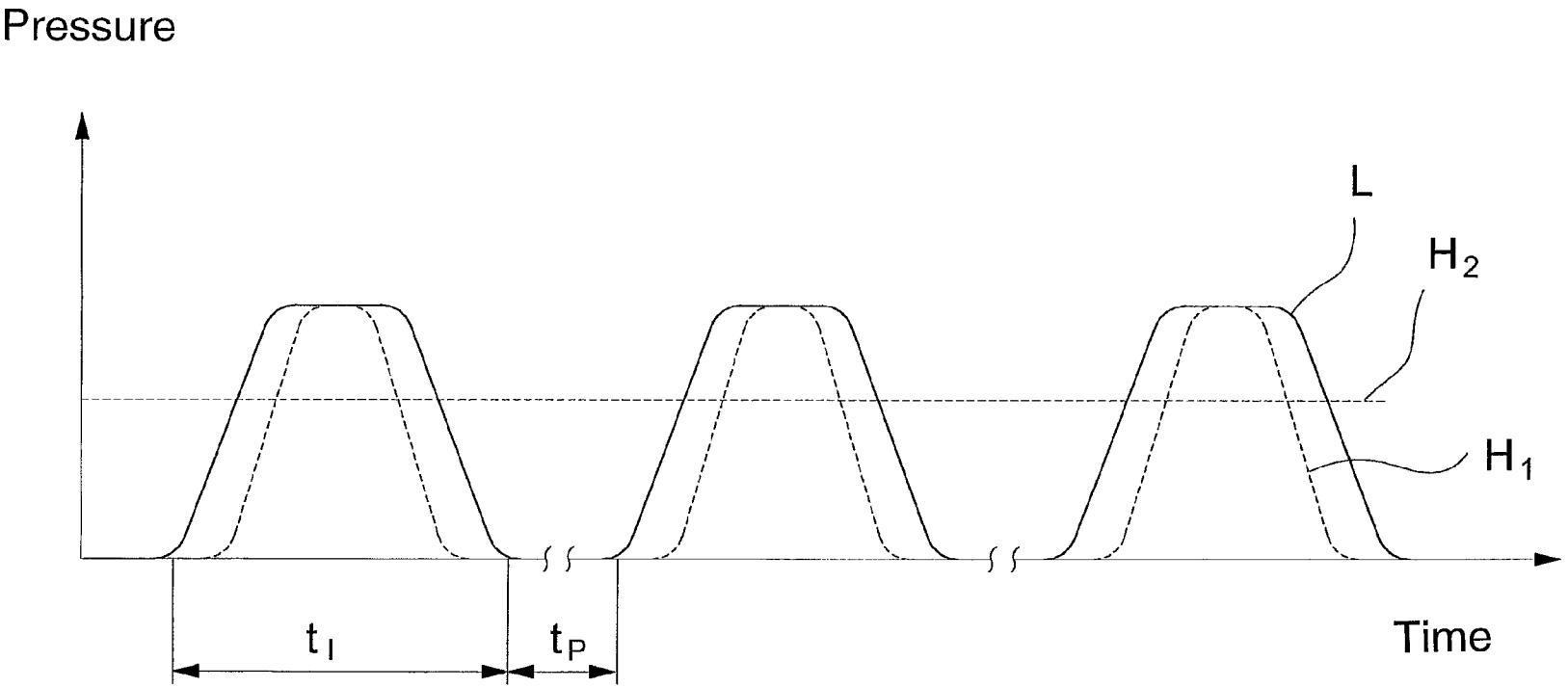
Figure 4:
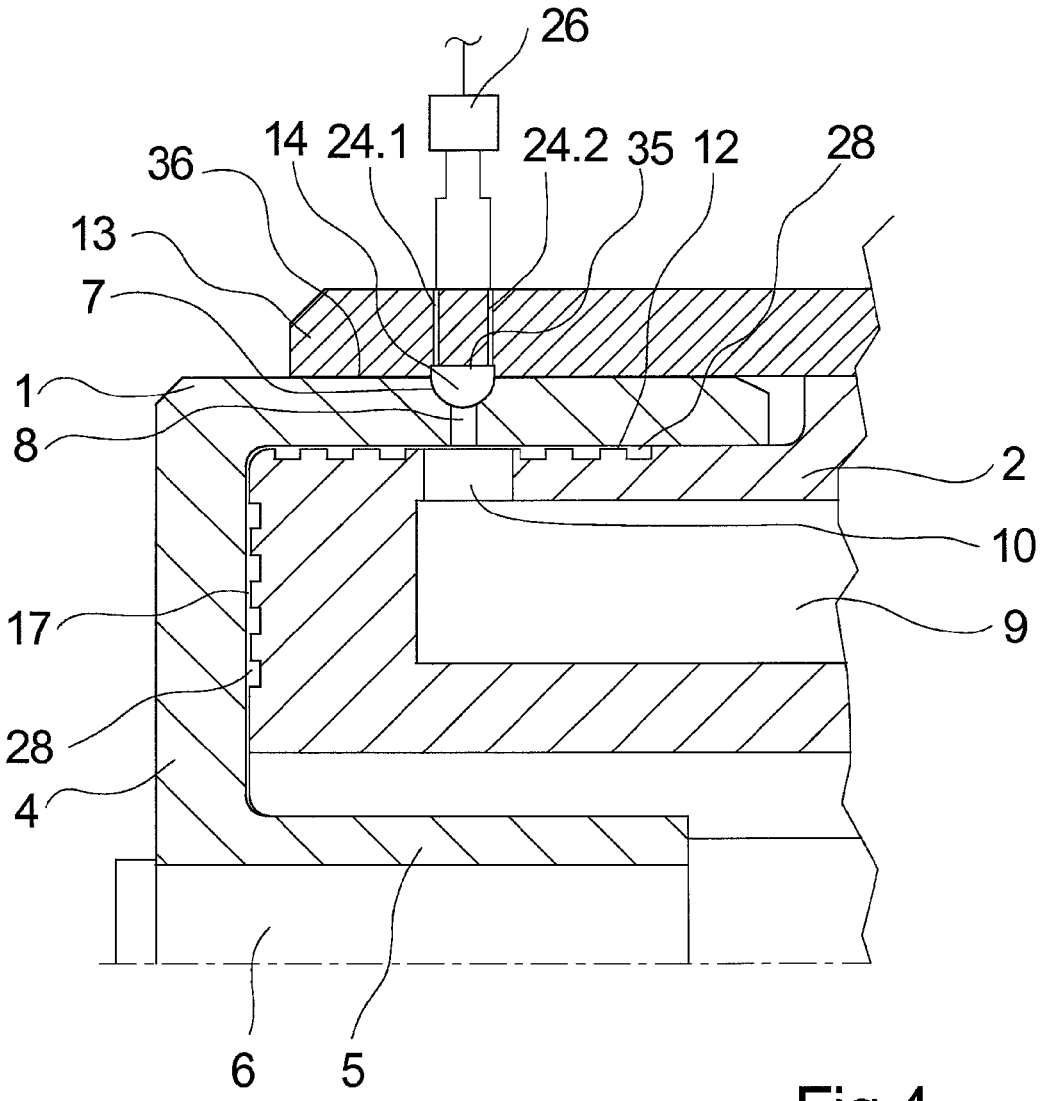
Figure 6:
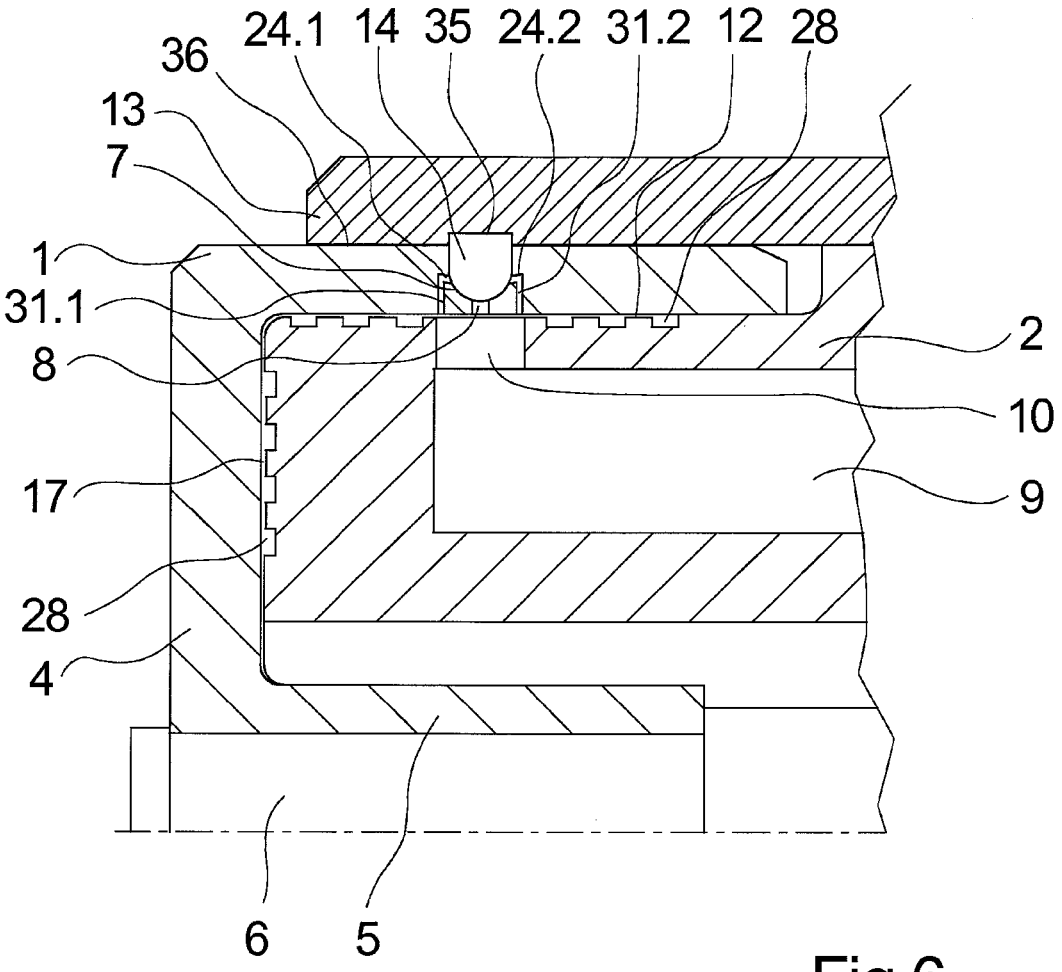
Figure 7:
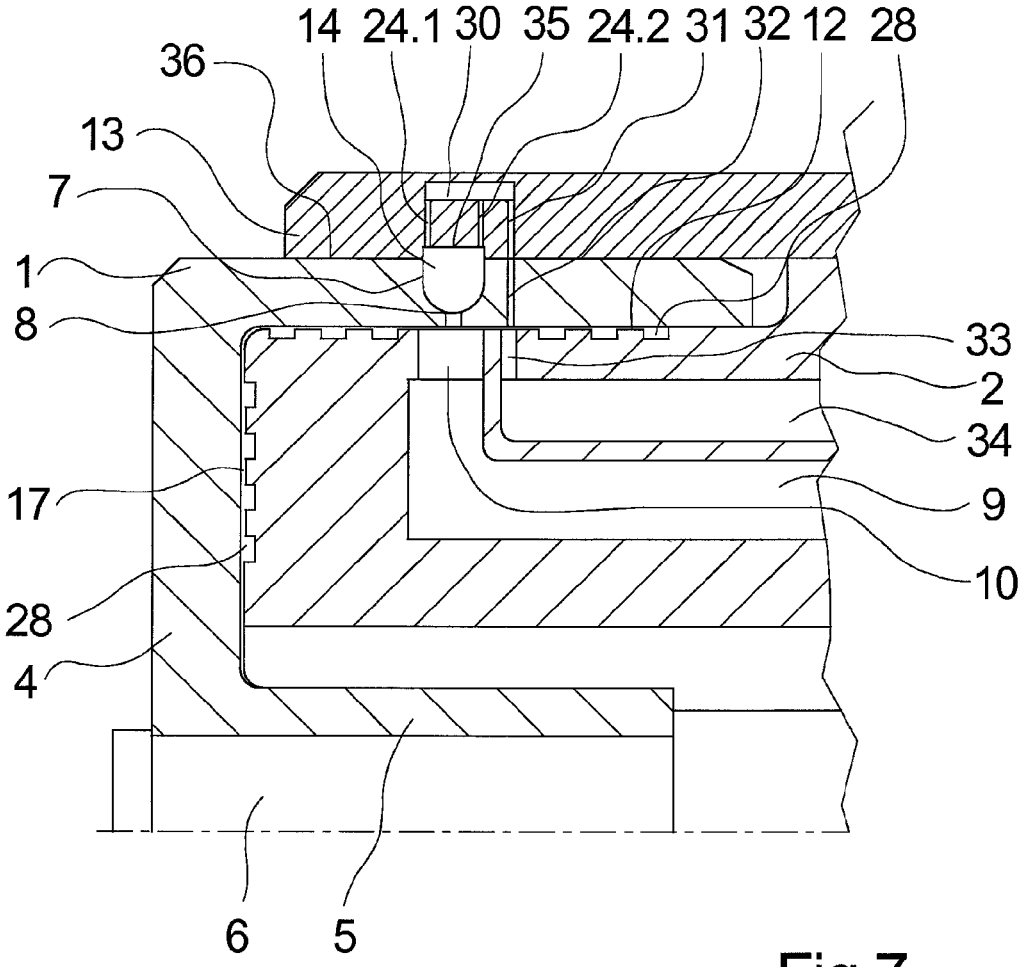

In the drawings:

FIG. 1 shows schematically a longitudinal sectional view of a first embodiment of the device according to the invention, FIG. 2 shows schematically a cross-sectional view of the embodiment according to FIG. 1, FIG. 3 shows schematically a time progression of the generated air stream pulses and auxiliary air streams, FIG. 4 shows schematically a longitudinal sectional representation of a further embodiment of the device according to the invention, FIGS. 5.1 and 5.2 show schematically a partial view of a longitudinal sectional representation of a further embodiment of the device according to the invention, FIG. 6 shows schematically a partial view of a longitudinal sectional representation of a further embodiment of the device according to the invention, FIG. 7 shows schematically a partial view of a longitudinal sectional representation of a further embodiment of the device according to the invention.

In FIGS. 1 and 2 a first embodiment of the device according to the invention is shown in several views. FIG. 1 shows the embodiment in a longitudinal sectional view, and in FIG. 2 the embodiment is shown in a cross-sectional view. In so far as no explicit reference is made to one of the figures, the following description applies to both figures.

The embodiment of the device according to the invention for producing intertwining knots in a multifilament thread has a rotating nozzle ring 1 which is constructed in a ring and supports a circumferential guide groove 7 on its circumference. A plurality of nozzle channels 8 which are uniformly distributed over the circumference of the nozzle ring 1 open in the groove base of the guide groove 7. In this embodiment two nozzle channels 8 are contained in the nozzle ring 1. The nozzle channels 8 penetrate the nozzle ring 1 as far as its internal diameter. The number of nozzle channels 8 and the position of the nozzle channels 8 in the nozzle ring 1 are given by way of example. The number and position are determined substantially from the required number of knots per length of thread as well as a pattern of knots.

The nozzle ring 1 is connected to a drive shaft 6 by means of an end wall 4 constructed on an end face and a hub 5 disposed centrally on the end wall 4. For this purpose the hub 5 is fastened on the free end of the drive shaft 6. The nozzle ring 1 is rotatably guided on an end face 29 of a stator 2. An all-round sealing gap 12 is formed between the stator 2 and the nozzle ring 1. The sealing gap 12 has a gap height in the range from 0.01 mm to 0.1 mm, so that the nozzle ring 1 is guided without contact on the circumference of the stator 2.

Inside the sealing gap 12 the stator 2 has on its circumference a chamber opening 10 which is connected to a pressure chamber 9 formed in the interior of the stator 2. The pressure chamber 9 is connected by means of a compressed air connection 11 to a compressed air source 25. A pressure reservoir 27 is provided between the pressure chamber 9 and the compressed air source 25.

The chamber opening 10 on the stator 2 and the nozzle channels 8 of the nozzle ring 1 are constructed in a plane, so that by rotation of the nozzle ring 1 the nozzle channels are guided alternately in the region of the chamber opening 10. For this purpose the chamber opening 10 is constructed as a longitudinal hole and extends in the radial direction over a relatively long guide region of the nozzle channels 8. Thus the size of the chamber opening 10 determines an opening time of the respective nozzle channel 8, which is designated here as the pulse time and defines the time period during which an air stream pulse is generated.

The time period until the nozzle channel 8 offset by 180° penetrates into the opening region of the chamber opening 10 is defined here as the interval. During the interval the chamber opening 10 on the stator 2 is closed by the nozzle ring 1. Thus both the pulse time and also the interval can be changed by the rotational speed of the nozzle ring 1.

An axial gap 17 is formed between the end wall 4 of the nozzle ring 2 and the end 29 of the stator 1. The axial gap 17 is preferably somewhat larger than the radial gap 12 on the circumference of the stator 2.

The stator 2 is held on a support 3 and has a central bearing bore 18 which is constructed concentrically with respect to the sealing gap 12. Within the bearing bore 18 a drive shaft 6 is rotatably supported by a bearing 23.

The drive shaft 6 is coupled at one end to a drive 19 by which the nozzle ring 1 can be driven at a predetermined rotational speed. The drive 19 could be formed for example by an electric motor which is disposed laterally on the stator 2.

As can be seen from the representation in FIG. 1, a cover 13 which is held by the carrier 3 is associated with the nozzle ring 1 on the circumference.

As can be seen additionally from the representation in FIG. 2, the cover 13 extends in the radial direction on the circumference of the nozzle ring 1 over a region which includes the chamber opening 10 of the stator 2. On the side facing the nozzle ring 1 the cover has an adapted cover surface which completely covers the guide grooves 7 on the circumference of the nozzle ring 1 and thus together with the nozzle ring 1 forms a treatment channel 14. Inside the treatment channel 14 a thread 20 is guided in the guide groove 7 on the circumference of the nozzle ring 1. For this purpose an inlet thread guide 15 on an inlet side 21 and an outlet thread guide 16 on an outlet side 22 are associated with the nozzle ring 1. Thus the thread 20 can be led between the inlet thread guide 15 and the outlet thread guide 16 with a partial looping around the nozzle ring 1 inside the guide groove 7.

As can be seen from the representation in FIGS. 1 and 2, in the cover 13 an auxiliary nozzle channel 24 is formed which opens with one end into the treatment channel 14 and with the opposite end is connected via a pressure valve 26 to the compressed air source 25. In this embodiment the auxiliary nozzle channel 24 is disposed in the cover 13 opposite the guide groove 7 of the nozzle ring 1. The auxiliary nozzle channel 24 has a free flow cross-section which is substantially smaller than the free flow cross-section of the nozzle channel 8. An auxiliary air stream generated by the auxiliary nozzle channel 24 forms a substantially smaller volumetric flow amount relative to the air stream pulse generated by the nozzle channel 8.

In the embodiment illustrated in FIGS. 1 and 2, for the production of intertwining knots in the multifilament threads 20 compressed air is introduced into the pressure chamber 9 of the stator 2. The nozzle ring 1 which guides the thread 20 into the guide groove 7 periodically generates air stream pulses as soon as the nozzle channels 8 enter the region of the chamber opening 10. In this case the air stream pulses lead to local swirling on the multifilament thread, so that a series of intertwining knots form on the thread. At the same time an auxiliary air stream, which is opposed to the blowing direction of the nozzle channel 8 and influences the distribution and formation of the air stream within the treatment channel 14 for improved knot formation, is blown into the treatment channel through the auxiliary nozzle channel 24.

At this point reference is additionally made to FIG. 3 for explanation of the method according to the invention.

FIG. 3 shows in a diagram a pressure profile of the air stream pulses and of the auxiliary air stream over time. In this case the time axis is formed by the abscissa formed and the pressure of the air stream pulse and of the auxiliary air stream is shown on the ordinate.

As can be seen from the representation in FIG. 3, the air pressure pulses generated by the nozzle channels 8 are in each case of the same magnitude, so that in each case a constant pulse time is set. The pulse time is shown by the lower-case letter t on the time axis. There is an interval between the successive air stream pulses. The interval is identified by the lower-case letters $t_p$. In this case constant pulse times and constant intervals are maintained due to a constant rotational speed of the nozzle ring during the swirling of the thread. The pressure profile of the air stream pulses is depicted by a continuous line which is denoted by the reference sign L. The duration of the pulse time and the intervals is dependent upon the number of nozzle channels 8 on the nozzle ring 1, the size the chamber opening 10 and the rotational speed of the nozzle ring 1.

The auxiliary air stream blown in through the auxiliary nozzle channel 24 acts simultaneously in addition to the air stream pulse in the treatment chamber 14. Two different variants of the method are possible for swirling of the thread. In a first variant the auxiliary air stream is generated only with the pulse time, so that the auxiliary air stream is blown in pulses into the treatment channel 14. In FIG. 3 the pressure profile of the auxiliary air stream is depicted by a broken line and is designated by the letters $H_1$ and $H_2$. The designation $H_1$ here stands for the generation of the auxiliary air stream in pulses. As can be seen from the representation in FIG. 3, the time period of the auxiliary air stream is less than the pulse time $t_1$. Moreover the auxiliary air stream and the air stream pulse are generated in such a way that the maximum of the auxiliary air stream is formed in the middle of the pulse time. The pressure profiles of the auxiliary air stream and of the air stream pulses are formed symmetrically relative to one another. In principle, however it is also possible for the pressure profiles to be asymmetrical relative to one another, so that for example the auxiliary air stream is only generated after half the pulse time is exceeded, so that the main effect of the auxiliary air stream takes place during the decay of the air stream pulse. Furthermore the pulse times of the auxiliary air stream are selected to be the same as the pulse times of the air stream pulse. Moreover in FIG. 3 it is shown that both air streams are generated with the same compressed air level, so that the maximum pressure is of the same magnitude. Alternatively, however, the air pressure pulse and the auxiliary air stream could also be generated with different compressed air levels.

In the embodiment illustrated in FIGS. 1 and 2 the pulsed progression of the auxiliary air stream shown in FIG. 3 could be generated by corresponding control of the pressure valve 26, so that a pulsed auxiliary air stream is blown into the treatment channel 14 in each case via the auxiliary nozzle channel.

Alternatively, however, the possibility also exists that a permanent compressed air stream is delivered to the auxiliary nozzle channel 24 by means of the pressure valve 26, so that the auxiliary air stream is constantly blown into the treatment channel 14.

In FIG. 3 the pressure profile of the continuously generated auxiliary air stream is depicted by a broken line and is designated by the identifier letters $H_1$ and $H_2$. In this embodiment the pressure level of the auxiliary pressure stream $H_2$ is less than the maximum compressed air level of the air stream pulses. Fundamentally, however, here too any pressure can be set for generation of the auxiliary air stream by means of the pressure valve 26.

Overall, however, it has been shown that the swirling of the thread within the treatment channel 14 can be positively influenced by the auxiliary air stream in such a way that the pressure level and the pulse time of the air stream pulses can be reduced. Thus by comparison with the methods and devices which are known in the prior art energy savings can be achieved while the knot quality remains the same and the number of knots in the multifilament thread remains the same.

The method according to the invention can be carried out not only by the device shown in FIGS. 1 and 2. Fundamentally the pulsed air stream pulses can also be achieved by valve control, so that the treatment channel could be formed between stationary plates. However, the relatively large number of intertwining knots per length of thread can be implemented in a melting and spinning process preferably using the device according to FIGS. 1 and 2.

In FIG. 4 a further alternative embodiment of the device according to the invention is shown in a partial view of the longitudinal sectional representation. The embodiment according to FIG. 4 is substantially identical to the embodiment according to FIGS. 1 and 2, so that at this point reference is made to the aforementioned description and only the differences are explained below in order to avoid repetitions.

In the embodiment shown in FIG. 4 the cover 13 has a longitudinal groove 35 corresponding to the guide groove 7 on the side facing towards the nozzle ring 1. The longitudinal groove 35 advantageously extends over the entire length of the cover 13 and together with the guide groove 7 forms the treatment channel 14 in the nozzle ring 1. In the groove base the longitudinal grooves 35 each open into two auxiliary nozzle channels 24.1 and 24.2 spaced apart from one another. The auxiliary nozzle channels 24.1 and 24.2 in the cover 13 are offset with respect to one another in such a way that two parallel auxiliary air streams enter the treatment channel 14 in the region of the lateral flanks of the guide groove 7. The nozzle channel 8 which lies opposite when the nozzle ring is rotating during the pulse time opens into a central region of the guide groove 7 between the auxiliary nozzle channels 24.1 and 24.2.

In the cover 13 the auxiliary nozzle channels 24.1 and 24.2 are coupled by means of compressed air lines to the pressure valve 26 which is connected to the compressed air source 25 (not shown here).

The nozzle ring 1 is guided on the stator 2, wherein an all-round sealing gap 12 between the stator 2 and the nozzle ring 1 is sealed by a labyrinth seal. The labyrinth seal 28 extends on either side of the chamber opening 10 and is formed by a plurality of circumferential grooves on the stator 2.

Likewise the axial gap 17 between the stator 2 and the end wall 4 is sealed by a labyrinth seal 28 which is formed by hubs on the end faces of the stator 2.

The functioning of the embodiment of the device according to the invention illustrated in FIG. 4 is identical to the aforementioned embodiment, wherein the auxiliary air streams can be generated permanently or periodically by means of the auxiliary nozzle channels 24.1 and 24.2.

The embodiments of the device according to the invention illustrated in FIGS. 1 to 4 are preferably used in order to blow an auxiliary air stream permanently into the treatment channel 14 by means of the auxiliary nozzle channel 24. In order that a pulsed generation of the auxiliary air stream at higher frequencies can be achieved, the device according to the invention is preferably constructed in the version shown in FIGS. 5.1 and 5.2. In this case the embodiment is shown in a partial view of the longitudinal sectional representation, wherein in FIG. 5.1 the operational situation during an interval is shown and in FIG. 5.2 the operational situation during a pulse time is shown.

The embodiment according to FIGS. 5.1 and 5.2 is substantially identical to the embodiment according to FIGS. 1 and 2, so that reference is made below to the aforementioned description and only the differences are explained.

In the embodiment shown in FIGS. 5.1 and 5.2 two auxiliary nozzle channels 24.1 and 24.2 formed parallel adjacent to one another open into a longitudinal groove 35 which is formed in the cover 13 on the side facing the nozzle ring 1. Within the cover 13 a distribution chamber 30 is constructed in which the opposite ends of the auxiliary nozzle channels 24.1 and 24.2 open. The distribution chamber 30 extends in the axial direction in a region which covers the width of the longitudinal groove 35. A supply channel 31 which extends from the distribution chamber 30 as far as a separating gap 36 is formed inside the cover 13 at the end of the distribution chamber 30. The separating gap 36 forms the separation between the cover 13 and the rotating nozzle ring 1.

As can be seen in particular from FIG. 5.2, in addition to the guide groove 7 and the nozzle channel 8 the nozzle ring 1 supports a through channel 32 which is constructed parallel alongside the guide groove 7 and the nozzle channel 8 and which opens with one end into the separating gap 36 and co-operates with the opposing supply channel 31 in the cover 13. The opposing end of the through channel 32 ends in the sealing gap 12 and co-operates with the chamber opening 10 of the pressure chamber 9 in the stator 2.

In the situation shown in FIG. 5.2 both the air stream pulse and also the auxiliary air streams are supplied from the pressure chamber 9 of the stator 1. As soon as during rotation of the nozzle ring 1 the through channel 32 is in communication with the chamber opening 10 and with the supply channel 31, a compressed air stream is directed into the distribution chamber 30 of the cover 13. From the distribution chamber 30 the compressed air reaches the treatment chamber 14 as an auxiliary air stream in each case by means of the auxiliary nozzle channels 24.1 and 24.2.

In this case the length of time for generation of the auxiliary air streams is determined substantially by the geometry of the chamber opening 10, of the through channel 32 and of the supply channel 31. In particular the chamber opening 10 and the supply channel 31 have an elongate opening extending in the radial direction in order to obtain a sufficient time period for formation and generation of the auxiliary air streams.

In the situation shown in FIG. 5.1 the nozzle channel 8 and the through channel 32 is located in a changed angular position, so that the chamber opening 10 is closed and no stream of air is blown in within the treatment channel 14.

In the aforementioned embodiment the auxiliary nozzle channels 24.1 and 24.2 are disposed on the side of the treatment channel 14 facing the nozzle channel 8, so that opposing blowing directions are established. Fundamentally, however, it is also possible that the blowing directions of the auxiliary air streams generated through the auxiliary nozzle channels 24.1 and 24.2 open transversely into the treatment channel 14. In this connection FIG. 6 shows an embodiment which is identical in structure to the embodiment according to FIGS. 1 and 2. In this respect only the differences are explained here in order to avoid repetitions.

In the embodiment illustrated in FIG. 6 two opposing auxiliary nozzle channels 24.1 and 24.2 which open into the side wall of the guide groove 7 are provided in the nozzle ring 1. The auxiliary nozzle channels 24.1 and 24.2 are supplied by means of two supply channels 31.1 and 31.2 disposed parallel to one another, which are constructed parallel to the nozzle channel 8 on the nozzle ring 1 and during rotation of the nozzle ring 1 periodically co-operate via the chamber opening 10 of the pressure chamber 9. Thus advantageous pulsed auxiliary air streams can also be generated, which are blown in transversely with respect to the blowing direction of the air pressure pulses into the treatment channel 14.

In the embodiments illustrated in FIGS. 5 and 6 the generation of the air stream pulses and the auxiliary air streams takes place together by means of the pressure chamber 9 formed in the stator. Thus the air stream pulses and the auxiliary air streams are generated at the same pressure level. Fundamentally, however, it is also possible to generate the air stream pulses and the auxiliary air streams at different pressure levels. In this connection FIG. 7 shows an embodiment which is identical to the embodiment according to FIG. 5.2. In this respect reference is made to the aforementioned description and only the differences are explained below.

In the embodiment illustrated in FIG. 7 the through channel 32 in the nozzle ring 1 is periodically connected separately to an auxiliary chamber opening 33 and an auxiliary pressure chamber 34 in the stator 2 by rotation of the nozzle ring 1. The nozzle channel 8 formed in the nozzle ring 1 co-operates with the chamber opening 10 and the pressure chamber 9. The pressure chamber 9 and the auxiliary pressure chamber 34 are separate from one another and can be operated in the stator 2 by different compressed air supply at different pressure. In this respect it is possible to generate the auxiliary air streams and the air stream pulse at different operating pressures. The operating pressures are usually in a range from 0.5 bar to 10 bar.

The illustrated embodiments of the device according to the invention are all suitable for carrying out the method according to the invention. Fundamentally the method according to the invention can also be operated by such devices in which the treatment channel is constructed to be stationary and in which the nozzle channel an air supply which generates pulsed compressed air streams and introduces them into the nozzle channels is provided in the nozzle channel. Such air supplies may be implemented for example by rotating pressure chambers or compressed air valves.

LIST OF REFERENCE SIGNS

1 nozzle ring
2 stator
3 support
4 end wall
5 hub
6 drive shaft
7 guide groove
8 nozzle channel
9 pressure chamber
10 chamber opening
11 compressed air connection
12 sealing gap
13 cover
14 treatment channel
15 inlet thread guide
16 outlet thread guide
17 axial gap
18 bearing bore
19 drive
20 thread
21 inlet side
22 outlet side
23 bearing
24 auxiliary nozzle channel
25 compressed air source
26 pressure valve
27 pressure reservoir
28 labyrinth seal
29 end face
30 distribution chamber
31 supply channel
32 through channel
33 auxiliary chamber opening
34 auxiliary pressure chamber
35 longitudinal groove
36 separating gap

The invention claimed is:

1. Device for producing intertwining knots in a multifilament thread, the device comprising:

a rotating nozzle ring, which has on a circumference of the nozzle ring a circumferential guide groove and at least one nozzle channel which opens radially into the guide groove, a stator which has a pressure chamber with a chamber opening, wherein the pressure chamber can be connected via a compressed air connection to a compressed air source and wherein by rotation of the nozzle ring the nozzle channel can be connected to the pressure chamber via the chamber opening in order to produce an air stream pulse, and a cover which is associated with a portion of the guide groove and forms a treatment channel in the guide groove together with the nozzle ring opposite the chamber opening of the stator, wherein at least one of the nozzle ring and the cover has at least one auxiliary nozzle channel opening into the treatment channel, wherein the auxiliary nozzle channel is connected constantly to the compressed air source, wherein the auxiliary nozzle channel has a free flow cross-section which is smaller than a flow cross-section of the nozzle channel, and wherein the auxiliary nozzle channel and the nozzle channel open, offset with respect to one another, into the treatment channel in such a way that different blowing directions can be produced.

2. Device according to claim 1, wherein the cover has a plurality of auxiliary nozzle channels which are constructed opposite the guide groove of the nozzle ring and which can be connected jointly to the compressed air source.

3. Device according to claim 1, wherein the cover has a distribution chamber and a supply channel which opens into the distribution chamber, wherein an opposite end of the auxiliary nozzle channel opens into the distribution chamber and wherein the supply channel co-operates periodically with a through channel in the nozzle ring.

4. Device according to claim 3, wherein the through channel of the nozzle ring co-operates by means of the chamber opening with the pressure chamber in the stator.

5. Device according to claim 1, wherein the nozzle ring has two opposing auxiliary nozzle channels which open into side walls of the guide groove, wherein the auxiliary nozzle channels co-operate through a plurality of supply channels by means of the chamber opening with the pressure chamber in the stator.

6. Device according to claim 3, wherein the through channel of the nozzle ring co-operates by means of an auxiliary chamber opening with a separate auxiliary pressure chamber in the stator.

7. Device according to claim 1, wherein the cover has said at least one auxiliary nozzle channel opening into the treatment channel.

8. Device according to claim 1, wherein an auxiliary air stream is permanently blown into the treatment channel by means of the auxiliary nozzle channel and wherein the auxiliary air stream and the air stream pulse produced by means of the nozzle channel are blown in together into the treatment channel when the nozzle channel is connected to the pressure chamber.

9. Device according to claim 1, wherein the cover, on its side facing towards the nozzle ring, has a longitudinal groove corresponding to the guide groove of the nozzle ring.

10. Device according to claim 9, wherein the longitudinal groove of the cover extends over the entire length of the cover and together with the guide groove of the nozzle ring forms the treatment channel.

11. Device according to claim 10, wherein two auxiliary nozzle channels which are formed in the cover and which are spaced apart from one another open into a groove base of the longitudinal groove of the cover.

12. Device according to claim 11, wherein the two auxiliary nozzle channels in the cover are offset with respect to one another in such a way that two parallel auxiliary air streams enter the treatment channel.

13. Device according to claim 12, wherein the two auxiliary nozzle channels open into the groove base of the longitudinal groove of the cover in the region of opposite lateral flanks of the longitudinal groove of the cover, and wherein the nozzle channel opens into a central region of the guide groove of the nozzle ring and wherein the nozzle channel lies opposite and between the two auxiliary nozzle channels when the nozzle channel is connected to the pressure chamber.

14. Device according to claim 1, wherein two auxiliary nozzle channels are formed in the cover and wherein the two auxiliary nozzle channels are coupled by means of separate compressed air lines to a pressure valve which is connected to the compressed air source.

15. Device according to claim 1, wherein the nozzle ring is guided on the stator, wherein a circumferential sealing gap between the stator and the nozzle ring is sealed by a labyrinth seal.

16. Device according to claim 15, wherein the labyrinth seal extends on either side of the chamber opening and is formed by a plurality of circumferential grooves on the stator.

17. Device according to claim 1 wherein the nozzle ring is guided on the stator, wherein an axial gap between the stator and an end wall of the nozzle ring is sealed by a labyrinth seal which is formed by hubs on an end face of the stator.

18. Device according to claim 1, wherein the thread is guided with contact to the nozzle ring inside the circumferential guide groove of the nozzle ring.

19. Device according to claim 1, wherein two auxiliary nozzle channels which are formed in the cover and which are spaced apart from one another open into a groove base of the longitudinal groove of the cover.

* * * * *